US006571800B1

(12) United States Patent
Yu

(10) Patent No.: US 6,571,800 B1
(45) Date of Patent: Jun. 3, 2003

(54) TOBACCO FILLING DEVICE

(76) Inventor: Chin-Tung Yu, No. 79, Pingan Rd., Houli Shiang, Taichung 421 (TW)

( * ) Notice: Subject to any disclaimer, the term of this patent is extended or adjusted under 35 U.S.C. 154(b) by 0 days.

(21) Appl. No.: 10/104,155

(22) Filed: Mar. 25, 2002

(51) Int. Cl.[7] ..... A24C 5/02
(52) U.S. Cl. ..... 131/70; 131/75
(58) Field of Search ..... 131/70–74, 75–76

(56) References Cited

U.S. PATENT DOCUMENTS

| | | | | | |
|---|---|---|---|---|---|
| 200,889 | A | * | 3/1878 | Bishop | 131/77 |
| 685,009 | A | * | 10/1901 | Seropyan | 131/70 |
| 1,307,003 | A | * | 6/1919 | Friedberg | 131/70 |
| 2,167,773 | A | * | 8/1939 | Plaman et al. | 131/75 |
| 2,276,719 | A | * | 3/1942 | Daudelin | 131/75 |
| 2,425,888 | A | * | 8/1947 | Matteson et al. | 131/70 |
| 3,741,220 | A | * | 6/1973 | Meinunger | 131/70 |
| 4,632,129 | A | * | 12/1986 | Kastner | 131/70 |
| 4,771,793 | A | * | 9/1988 | Kastner | 131/70 |
| 5,657,768 | A | * | 8/1997 | Neumann et al. | 131/70 |
| 6,206,006 | B1 | * | 3/2001 | Schutze et al. | 131/70 |
| 6,345,624 | B1 | * | 2/2002 | Kastner | 131/70 |

* cited by examiner

*Primary Examiner*—James Derrington
*Assistant Examiner*—Carlos Lopez
(74) *Attorney, Agent, or Firm*—Charles E. Baxley

(57) ABSTRACT

A tobacco filling device includes a base with an outlet defined in a first end thereof and a cover is pivotally connected to a second end of the base. A pushing member is movably engaged with a slot defined in a top surface of the base. A plurality of pawls are connected to a top surface of the pushing member and each pawls has an end extending upward and away from the outlet. A knob is connected to the pushing member.

4 Claims, 4 Drawing Sheets

TOBACCO FILLING DEVICE

FIELD OF THE INVENTION

The present invention relates to a tobacco filling device which has a pushing member with a plurality of pawls extending from a top surface thereof and each pawls extending upward so as to fit the tobacco in the cigarette.

BACKGROUND OF THE INVENTION

A conventional tobacco filling device for filling tobacco into a cigarette is shown in FIG. 4 and includes a base 1 with a pushing member 12 movably received therein, an outlet 11 defined in an end of the base 1, a cover 13 movably connected to the other end of the base 1. The cover 13 has a pressing member 15 for pressing the tobacco in the pushing member 12 to be a desired shape and a fixing member 14 which is used to fix the cigarette at the outlet 11. The user has to hold the base 1 by one hand and push the cover 13 toward the outlet 11 with the other hand. After the tobacco in the pushing member 12 is sent in the cigarette, the cover 13 is moved backward. However, some of the tobacco will be brought out from the cigarette when moving the pushing member 12 backward.

SUMMARY OF THE INVENTION

In accordance with one aspect of the present invention, there is provided a tobacco filling device which comprises a base having an outlet defined in a first end thereof and a positioning tube is connected to a top surface of the first end of the base. A cover has a first end thereof pivotally connected to a second end of the base and a pressing member is connected to an underside of the cover. A fixing member is retractably connected the underside of a second end of the cover and located in alignment with the positioning tube. A pushing member is movably engaged with a slot in the base and a plurality of pawls are connected to a top surface of the pushing member. Each pawls has a first end fixed on the pushing member and a second end of each pawls extends upward and away from the positioning tube.

The primary object of the present invention is to provide a tobacco filling device wherein the tobacco is not brought from the cigarette when moving backward the pushing member.

Another object of the present invention is to provide a tobacco filling device that is easily to fill the cigarette by one hand.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
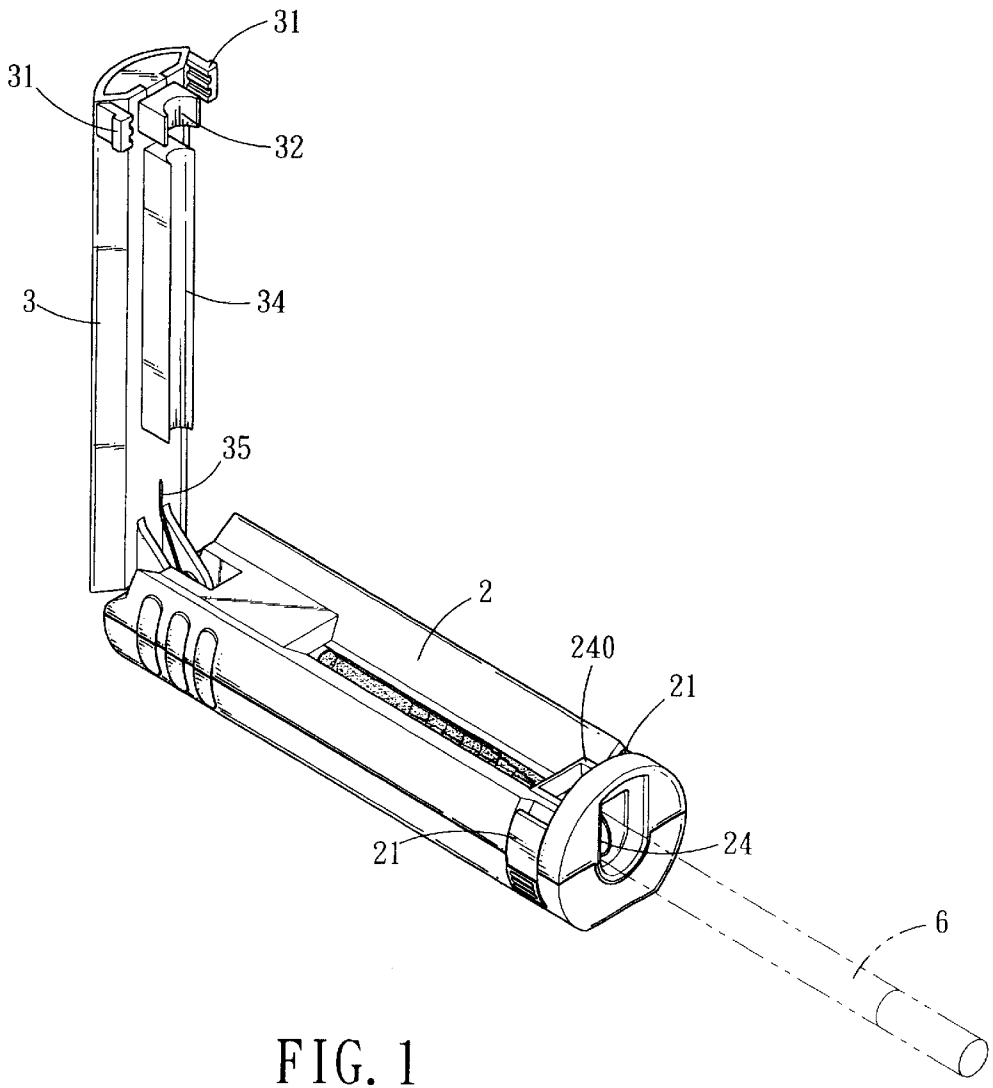
FIG. 1 is a perspective view to show the tobacco filling device of the present invention.
Figure 2:
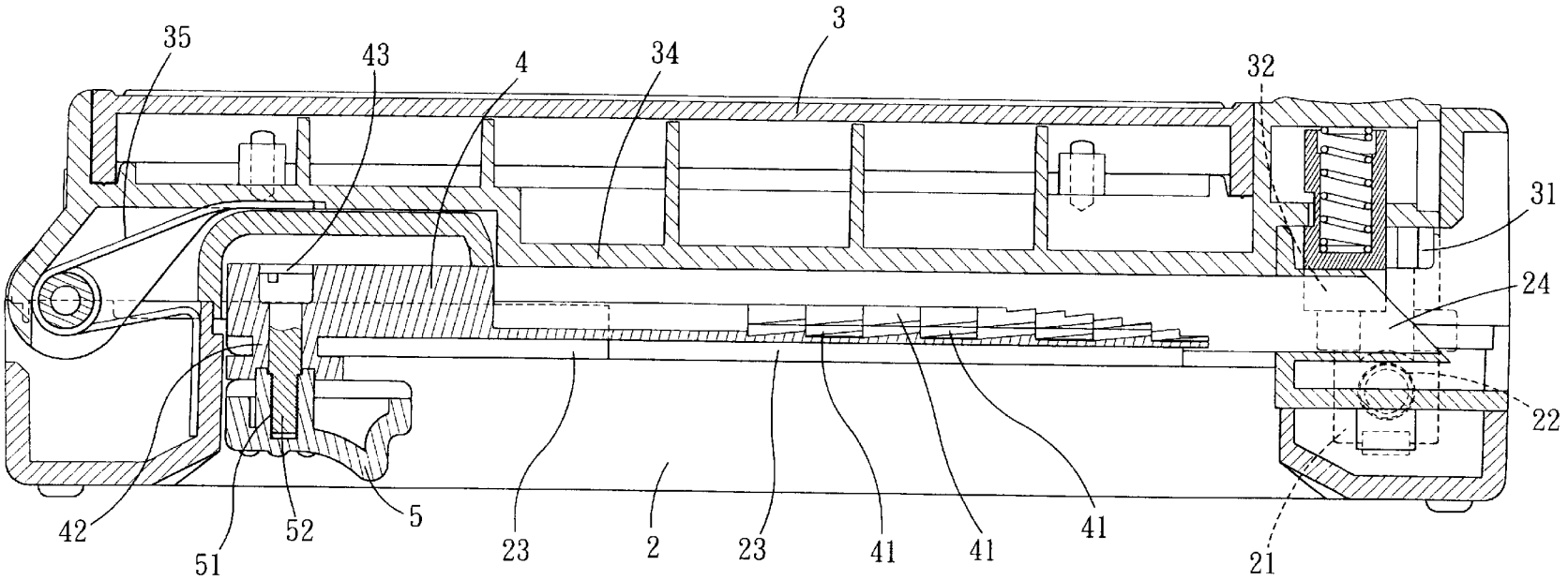
FIG. 2 is a cross sectional view to show the tobacco filling device of the present invention.
Figure 3:
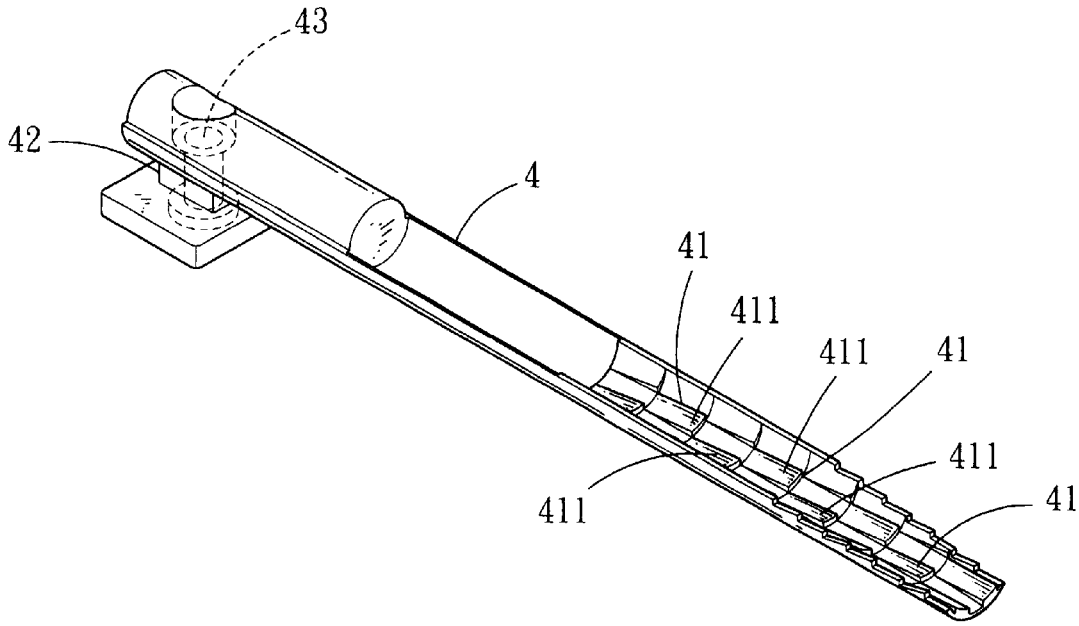
FIG. 3 is a perspective view to show the pushing member of the tobacco filling device of the present invention.
Figure 4:
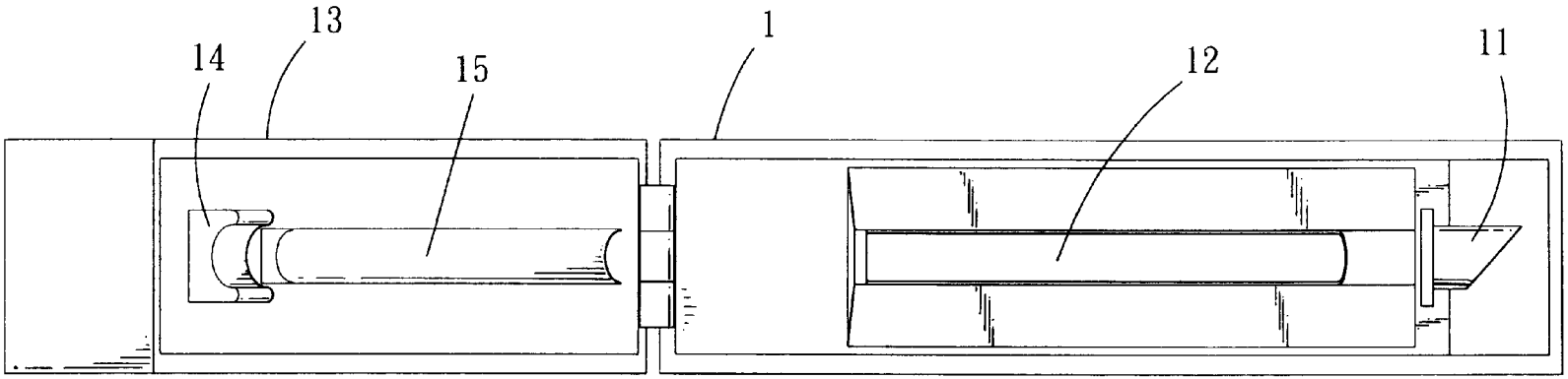
FIG. 4 PRIOR ART
FIG. 4 is a top view to show a conventional tobacco filling device.

Referring to FIGS. 1 to 3, the tobacco filling device of the present invention comprises a base 2 which has an outlet 24 defined in a first end thereof and a positioning tube 240 is connected to a top surface of the first end of the base 2. A slot 23 is defined in the top surface of the base 2 and two pushing, plates 21 are located at two sides of the positioning tube 240 and biased by two respective spring 22.

A pushing member 4 has an extension portion 42 which slidably extends through the slot 23 and is able to move along the slot 23. A plurality of pawls 41 are connected to a top surface of the pushing member 4. Each pawls 41 has a first end fixed on the pushing member 4 and a second end of each pawls 41 extends upward and away from the positioning tube 240 so as to form an inclined surface 411 on each pawl 41. A knob 5 having a threaded hole 51 defined therein is connected to the pushing member 4 by a bolt 52 extending through a top hole 43 in the extension portion 42 and threadedly engaged with the threaded hole 51 in the knob 5. The knob 5 is located at an underside of the base 2 so that the user can conveniently hold the knob 5 to slide the pushing member 4.

A cover 3 has a first end thereof pivotally connected to a second end of the base 2 and a pressing, member 34 is connected to an underside of the cover 3. A fixing member 32 is retractably connected the underside of a second end of the cover 3 and located in alignment with the positioning tube 240. Two engaging plates 31 extend from two sides of the second end of the cover 3. A torsion spring 35 has a first end mounted to a shaft extending through the first end of the cover 3 and the second end of the base 2, a second end of the torsion spring 35 being biased at the underside of the cover 3.

When in use, tobacco is put on the pushing member 4 and the cover 3 is mounted on the base 2 by engaging the two engaging plates 31 with the two pushing plates 21. Therefore, the user needs not to hold the cover 3. The tobacco on the pushing member 4 is pressed by the pressing member 34 and the user then slides the knob 5 to push the tobacco into the cigarette 6 which is inserted in the outlet 24 and clamped by the engagement of the fixing member 32 and the positioning tube 240.

The shape of the pawls 41 effectively push the tobacco into the cigarette 6 and when the pushing member 4 is moved backward, no tobacco is brought from the cigarette 6.

While we have shown and described the embodiment in accordance with the present invention, it should be clear to those skilled in the art that further embodiments may be made without departing from the scope of the present invention.

What is claimed is:

1. A tobacco filling device comprising:

a base having an outlet defined in a first end thereof and a positioning tube connected to a top surface of the first end of the base, a slot defined in the top surface of the base;

a cover has a first end thereof pivotally connected to a second end of the base and a pressing member connected to an underside of the cover, a fixing member retractably connected the underside of a second end of the cover and located in alignment with the positioning tube, and a pushing member movably engaged with the slot and a plurality of pawls connected to a top surface of the pushing member, each pawl having a first end fixed on the pushing member and a second end of each pawl extending upward so as to form an inclined surface.

2. The device as claimed in claim 1, wherein two pushing plates are located at two sides of the positioning tube and two engaging plates extend from two sides of the second end of the cover, the two engaging plates engaged with the two pushing plates.

3. The device as claimed in claim 1 further comprising a torsion spring which has a first end mounted to a shaft extending through the first end of the cover and the second end of the base, a second end of the torsion spring being biased at the underside of the cover.

4. The device as claimed in claim 1 further comprising a knob connected to the pushing member and located at an underside of the base.

* * * * *